US006601318B1

(12) United States Patent
Platsch

(10) Patent No.: US 6,601,318 B1
(45) Date of Patent: Aug. 5, 2003

(54) DRYER UNIT

(76) Inventor: Hans G. Platsch, Kupferstr. 40, Stuttgart D-70565 (DE)

( * ) Notice: Subject to any disclaimer, the term of this patent is extended or adjusted under 35 U.S.C. 154(b) by 0 days.

(21) Appl. No.: 09/590,053

(22) Filed: Jun. 8, 2000

(30) Foreign Application Priority Data

Jun. 10, 1999 (DE) ..... 299 10 122

(51) Int. Cl.[7] ..... F26B 9/00

(52) U.S. Cl. ..... 34/629; 34/267; 34/232; 34/114; 34/115; 34/121; 34/122; 219/388; 219/479; 392/379; 392/417

(58) Field of Search ..... 34/267, 232, 629, 34/114, 115, 121, 122, 123; 219/388, 479; 392/379, 417

(56) References Cited

U.S. PATENT DOCUMENTS 5,317,127 A * 5/1994 Brewster, Jr. et al. ..... 219/388
5,502,788 A * 3/1996 Platsch ..... 392/424
5,668,921 A * 9/1997 Essler ..... 392/379
5,991,506 A * 11/1999 Platsch ..... 392/379
6,088,931 A * 7/2000 Aylor et al. ..... 34/267

FOREIGN PATENT DOCUMENTS

| | | | |
|---|---|---|---|
| DE | 4442940 A1 | * | 6/1996 |
| DE | 4442942 A1 | * | 6/1996 |
| DE | 19651301 A1 | | 6/1998 |
| DE | 19701084 A1 | * | 7/1998 |
| DE | 29901402 U1 | | 6/1999 |
| EP | 0849079 A1 | * | 6/1998 |
| GB | 2280947 A | | 2/1995 |

* cited by examiner

*Primary Examiner*—William C. Doerrler
*Assistant Examiner*—Mark Shulman
(74) *Attorney, Agent, or Firm*—Factor & Partners

(57) ABSTRACT

A drier unit (10) for drying printed products has a plurality of drier rails (12), which comprise in each case a supporting body (14) manufactured from a hollow section (16). The clear outer contour of the cross-sectional area of the supporting bodies (14) is a rectangle. The drier rails (12) have in each case two resistance heating units (60) and additionally carry an infrared radiator (164).

22 Claims, 8 Drawing Sheets

Figure 1:
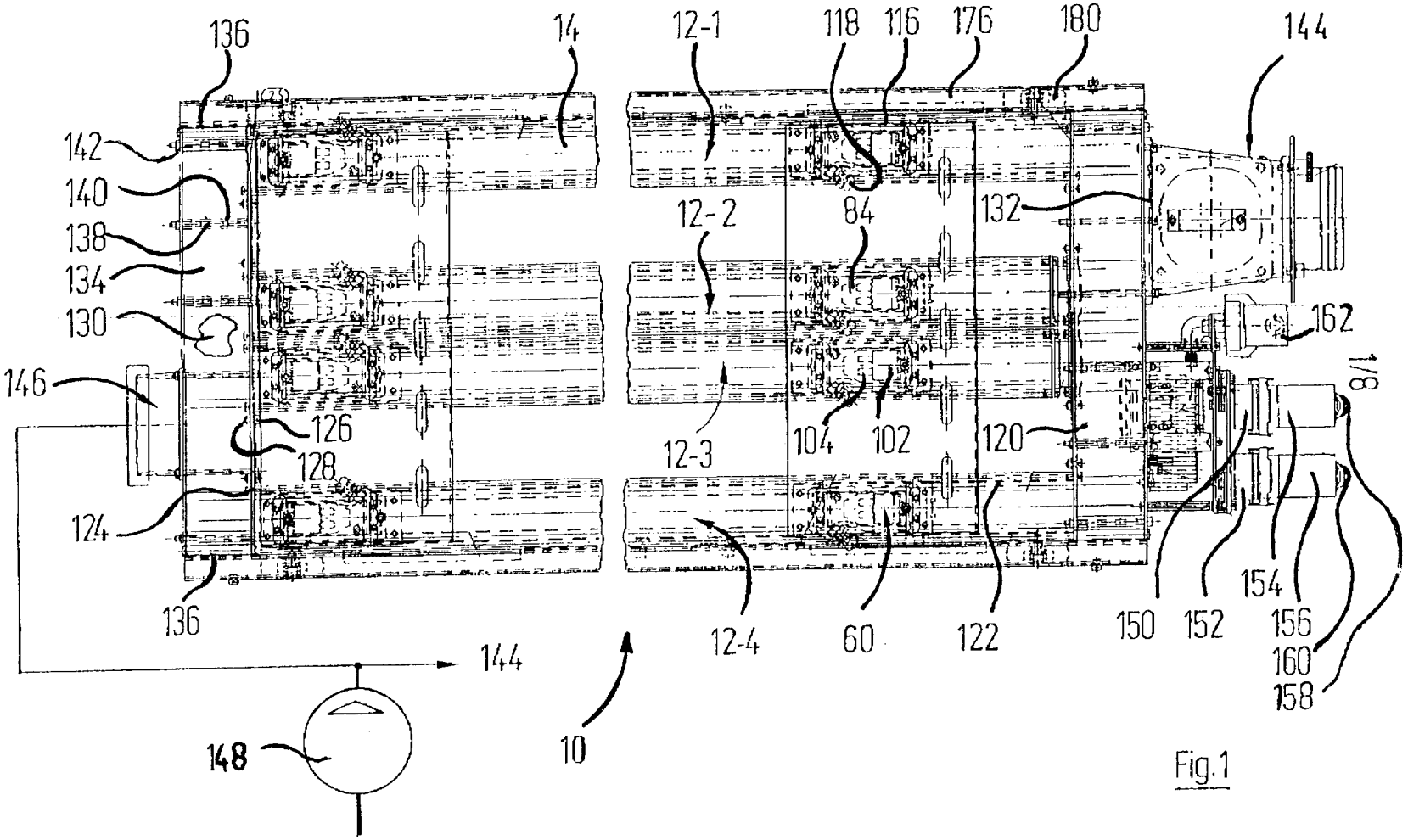

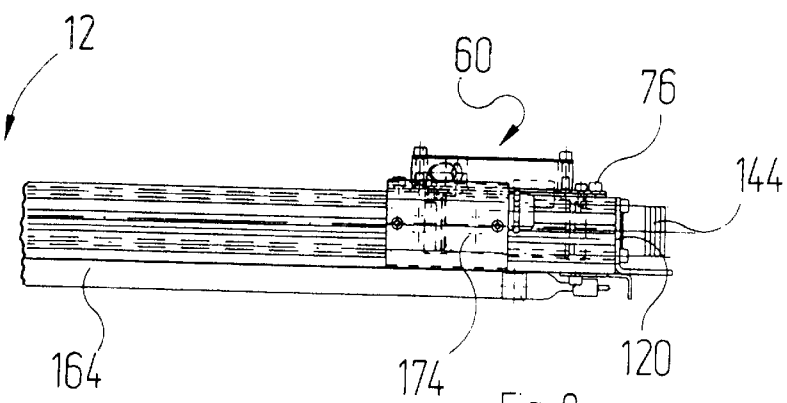
Fig. 8
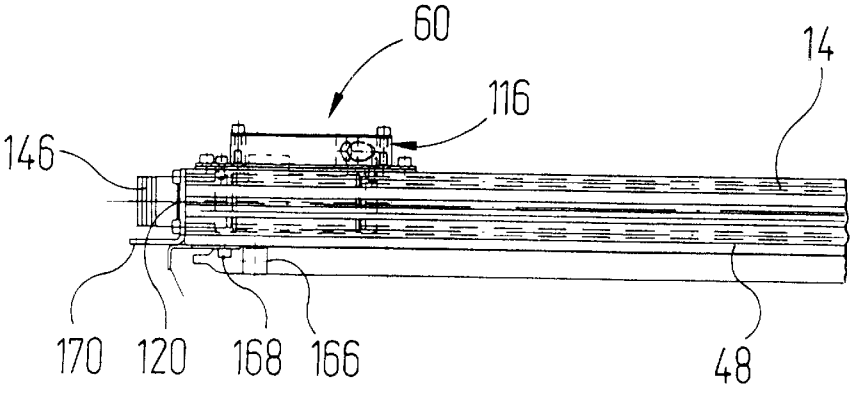
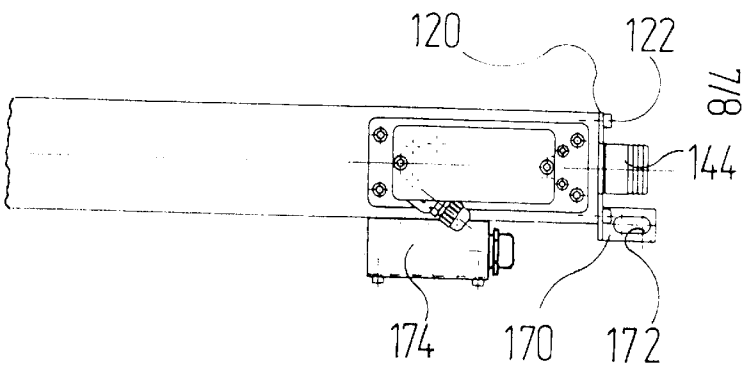
Fig. 9
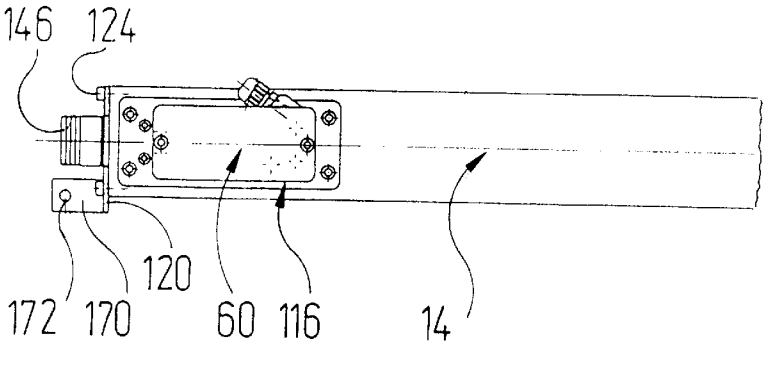

DRYER UNIT

The invention relates to a drier unit for drying printed products having at least one elongate supporting body and a heat source disposed on the latter.

Such drier units are in use in a different form, in particular as hot-air drier units and infrared drier units. They are assembled in each case from elements specific to the finished product.

The object of the present invention is to provide a drier unit, in which the supporting bodies may be provided either individually or arranged in groups closely adjacent to one another.

Said object is achieved according to the invention by a drier unit having the features indicated in claim 1.

Advantageous developments of the invention are indicated in sub-claims.

The development of the invention as claimed in claim 2 allows the formation, in longitudinal direction of the supporting body, of nozzle channels which have a greater axial dimension than corresponds to the wall thickness of the hollow section. The resultant effect is highly directional air jets, which emerge from the nozzle channels when compressed air is admitted into the interior of the hollow section.

The nozzle ribs moreover help to reinforce the box section.

The development of the invention as claimed in claim 3 allows an infrared radiator disposed between the two sets of nozzle channels to be cooled substantially symmetrically from both sides.

The development of the invention as claimed in claim 4 likewise achieves an additional stiffening of the hollow section. Furthermore, the guide walls, together with the inner surfaces of the hollow section adjacent to them, form a funnel-like structure, from which the nozzle channels emanate.

The development of the invention as claimed in claim 5 is advantageous in view of good strengthening with a low use of material and in view of an additionally improved funnel function.

The development of the invention as claimed in claim 6 also serves to strengthen the hollow section while providing it with a smooth outer periphery. In the region of the longitudinal reinforcing ribs there is moreover more substance, which facilitates and improves the fitting and guidance of additional components such as heating cartridges and the like.

In a drier unit as claimed in claim 7 clamping bolts or the like, by means of which end plates mounted onto the ends of the hollow section are braced with the hollow sections, may be guided in the interior of the hollow section. This is advantageous in view of a smooth outer periphery of the drier unit.

The development of the invention as claimed in claim 8 is advantageous in view of the fitting of additional components at the outside of the hollow bodies and in view of the concealed running of electric cable.

The development of the invention as claimed in claim 9 enables drying of the printed products with infrared rays.

According to claim 10 a drier unit is obtained, which delivers an air curtain, which is substantially constant over the length of the hollow sections and is heated up to a preset temperature immediately prior to the release into the environment. In said manner heat losses to the environment of the drier unit are kept low.

The development of the invention as claimed in claim 11 ensures precise positioning of the heating cartridge with a low outlay for equipment.

In said case, with the development of the invention as claimed in claim 12 it is guaranteed that the air sent through the heating cartridge is conveyed in a substantially laminar manner.

The development of the invention as claimed in claim 13 is advantageous in view of low manufacturing costs of the heating unit and in view of low throttling of the air.

In a drier unit as claimed in claim 14, a defective heating cartridge may be exchanged particularly easily and quickly.

The effect achieved by the development of the invention as claimed in claim 15 is that intimate contact is obtained between the air moving through the heating cartridge and the resistance wires. It is also possible, given the geometry indicated in claim 15, to accommodate a larger wire surface in a preset volume than with known solutions, in which the spiralled resistance wires extend in peripheral direction. Because of the, on the whole, greater volume available for receiving the resistance wire it is then possible (given the same heat output) for the resistance wire to be made slightly thicker so that the resistance wire material is heated less and the entire heating cartridge has a longer useful life.

The development of the invention as claimed in claim 16 allows the portions of the resistance wire, which are situated in adjacent chambers of the heating cartridge body which are sector-shaped in cross section, to be connected electrically to one another without the connecting wire portion projecting beyond the end face of the cartridge body.

The development of the invention as claimed in claim 17 is advantageous in view of the power connections to the heating cartridge being easy to establish.

According to claim 18, on the one hand a portion of the hollow sections in longitudinal direction is obtained and on the other hand via the end plates the various hollow sections of a drier unit may be mechanically combined into a unit.

The effect achieved by the development of the invention as claimed in claim 19 is that the end plates, which are used to combine the various hollow sections of a drier unit, simultaneously define part of a distribution channel, through which air is fed to the various hollow sections.

With the development of the invention as claimed in claim an intensive air supply from both ends of the supporting bodies is achieved.

Figure 2:
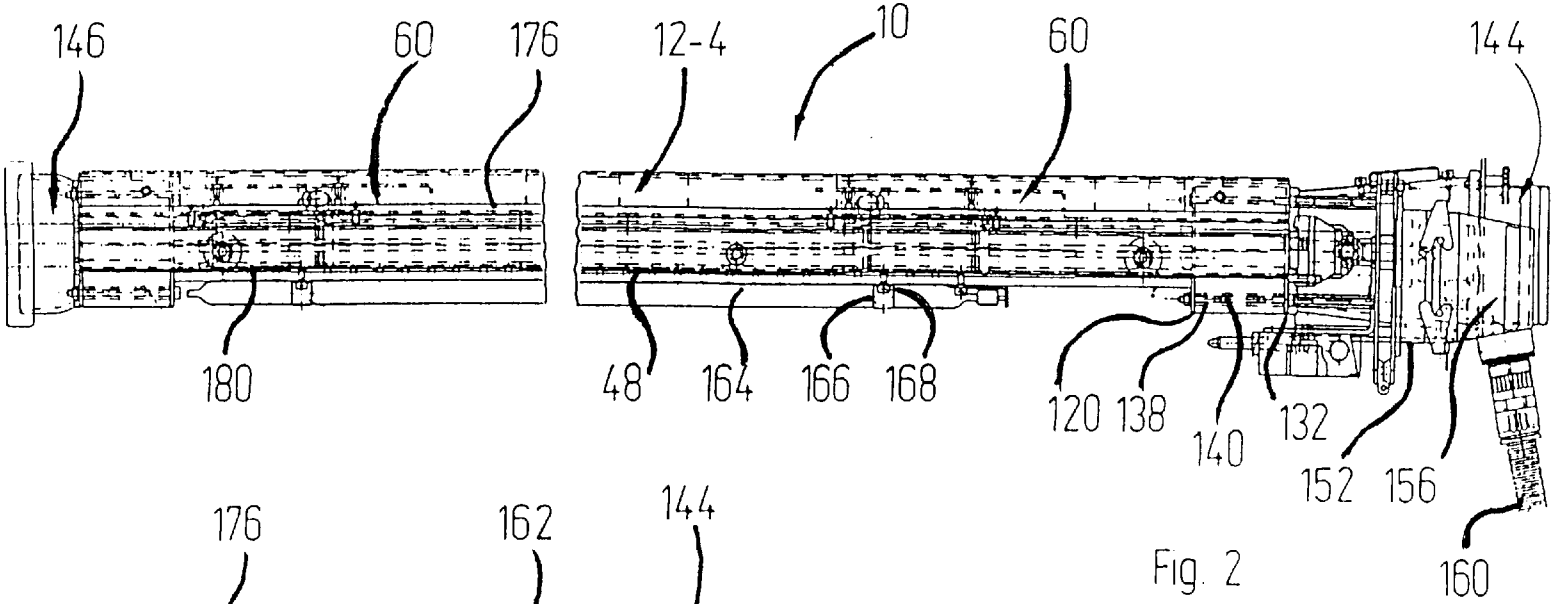
Figure 3:
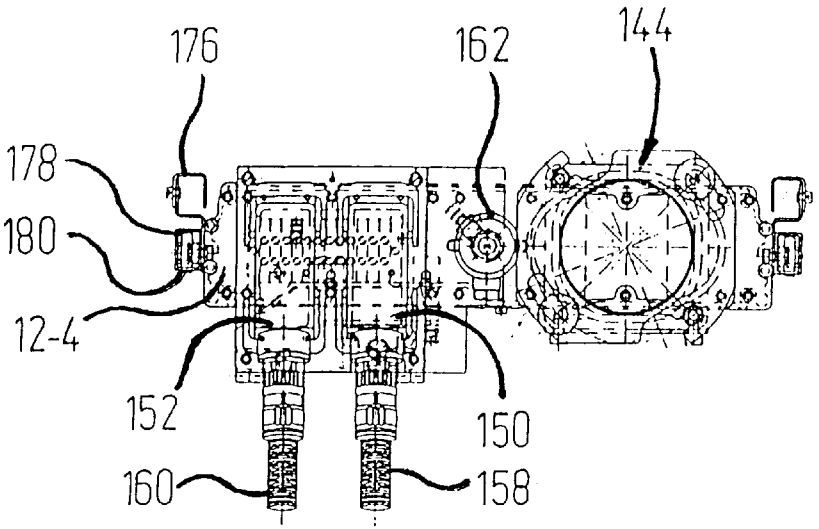
Figure 4:
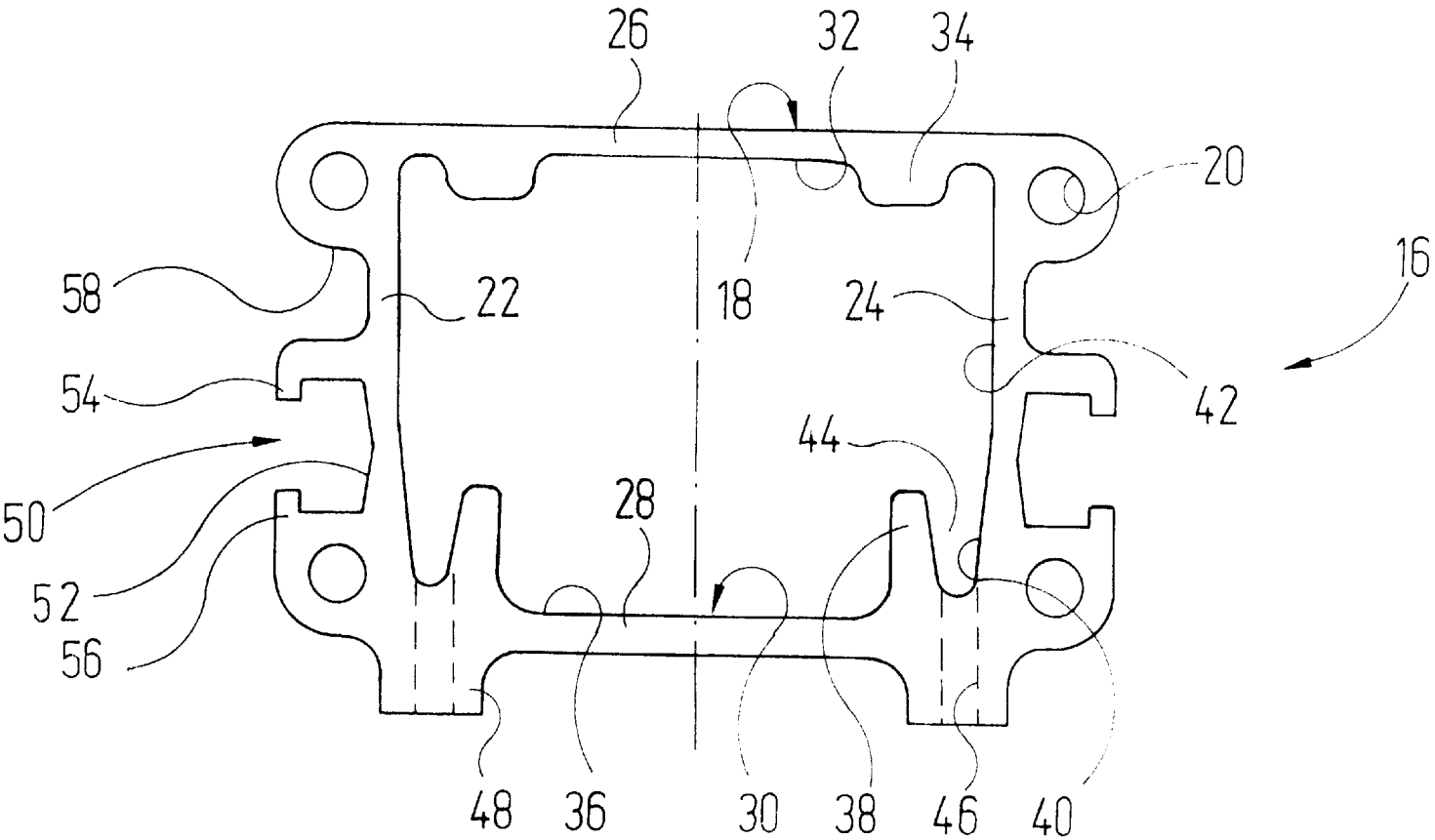
Figure 5:
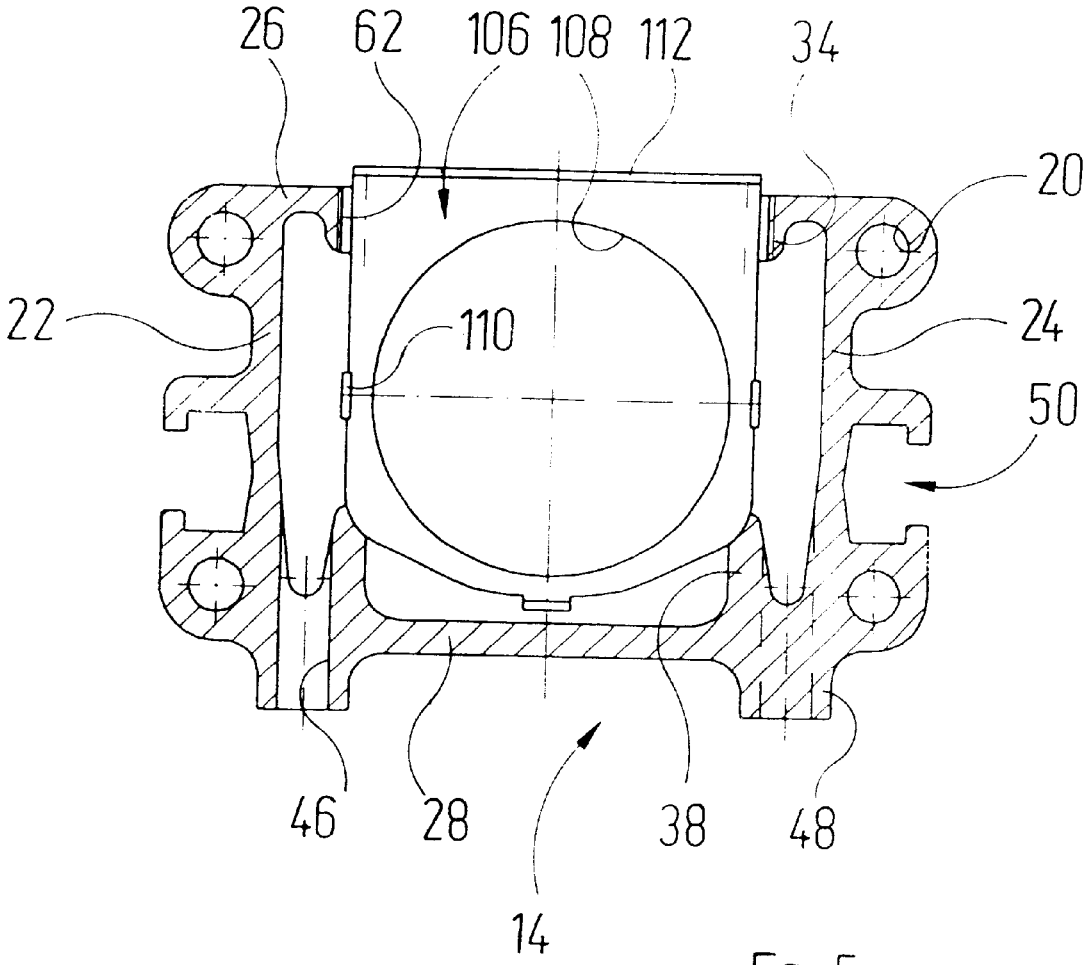
Figure 6:
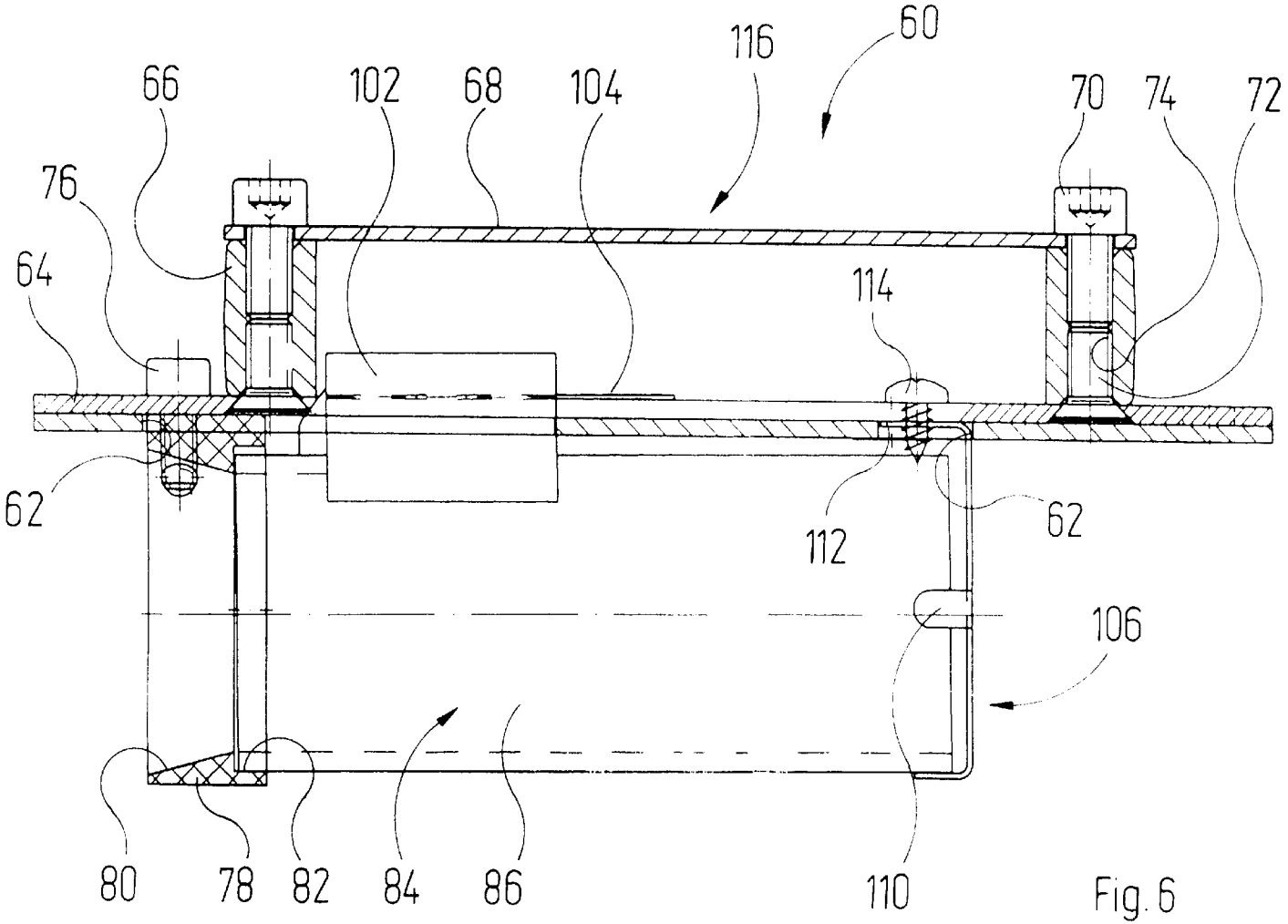
Figure 7:
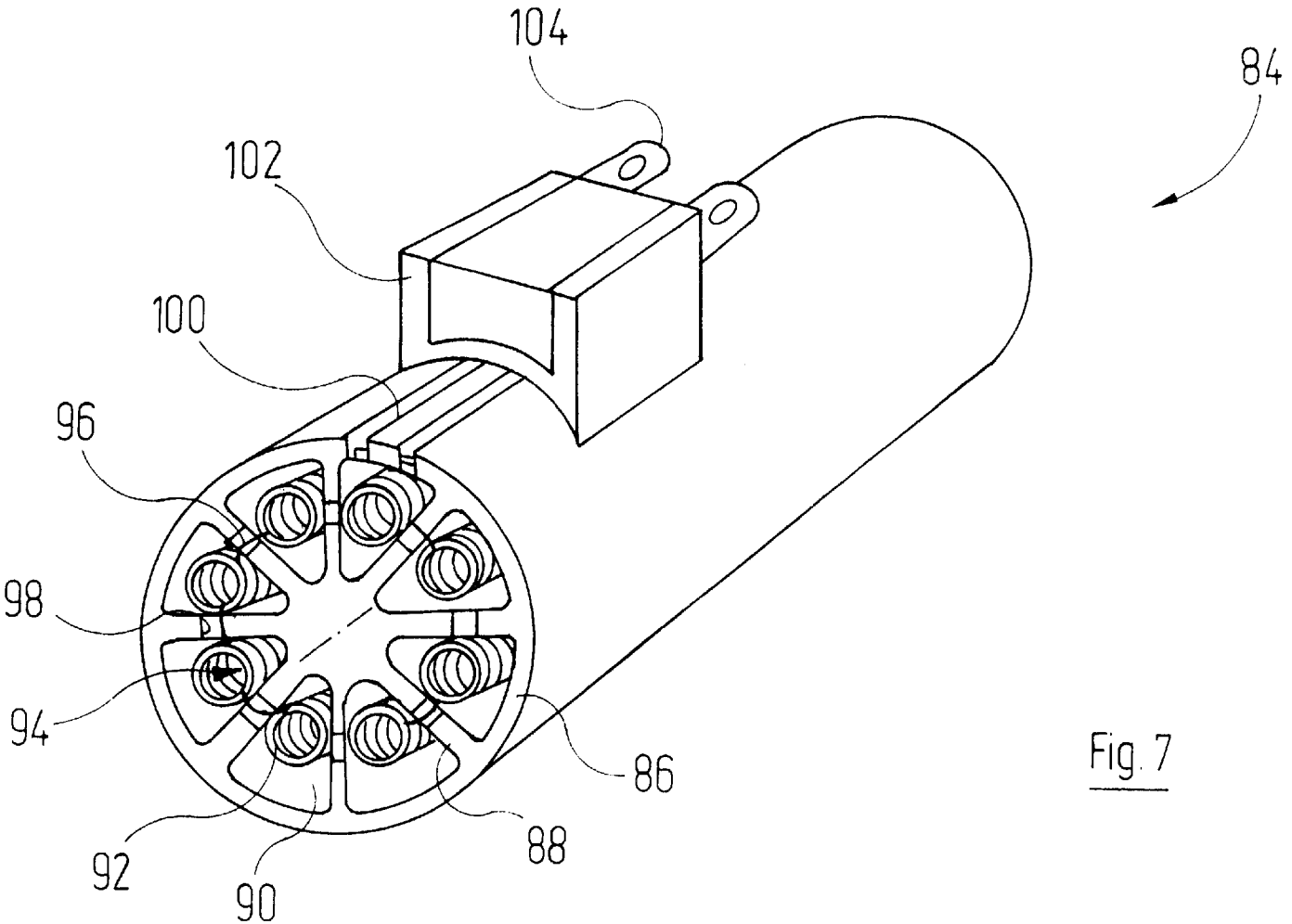

There now follows a detailed description of embodiments of the invention with reference to the drawings. Said drawings show:

FIG. 1: a plan view of a drier unit, which dries printed products simultaneously with hot air and infrared rays;

FIG. 2: a side view of the drier unit shown in FIG. 1;

FIG. 3: an end view of the drier unit shown in FIGS. 1 and 2 viewed from the right in FIG. 2;

FIG. 4: an end view of a hollow section, which is used to realize the drier unit according to FIGS. 1 to 3;

FIG. 5: a transverse section through a drier rail in the region of a heating cartridge inserted into the rail;

FIG. 6: a longitudinal partial section through the end of a drier rail in the region of a heating cartridge retaining part inserted into the rail;

FIG. 7: a perspective view of a heating cartridge, which is part of a resistance heating unit of a drier unit according to FIGS. 1 to 6;

FIG. 8: a side view of an individual drier rail;

FIG. 9: a plan view of the drier rail according to FIG. 8; and

Figure 10:
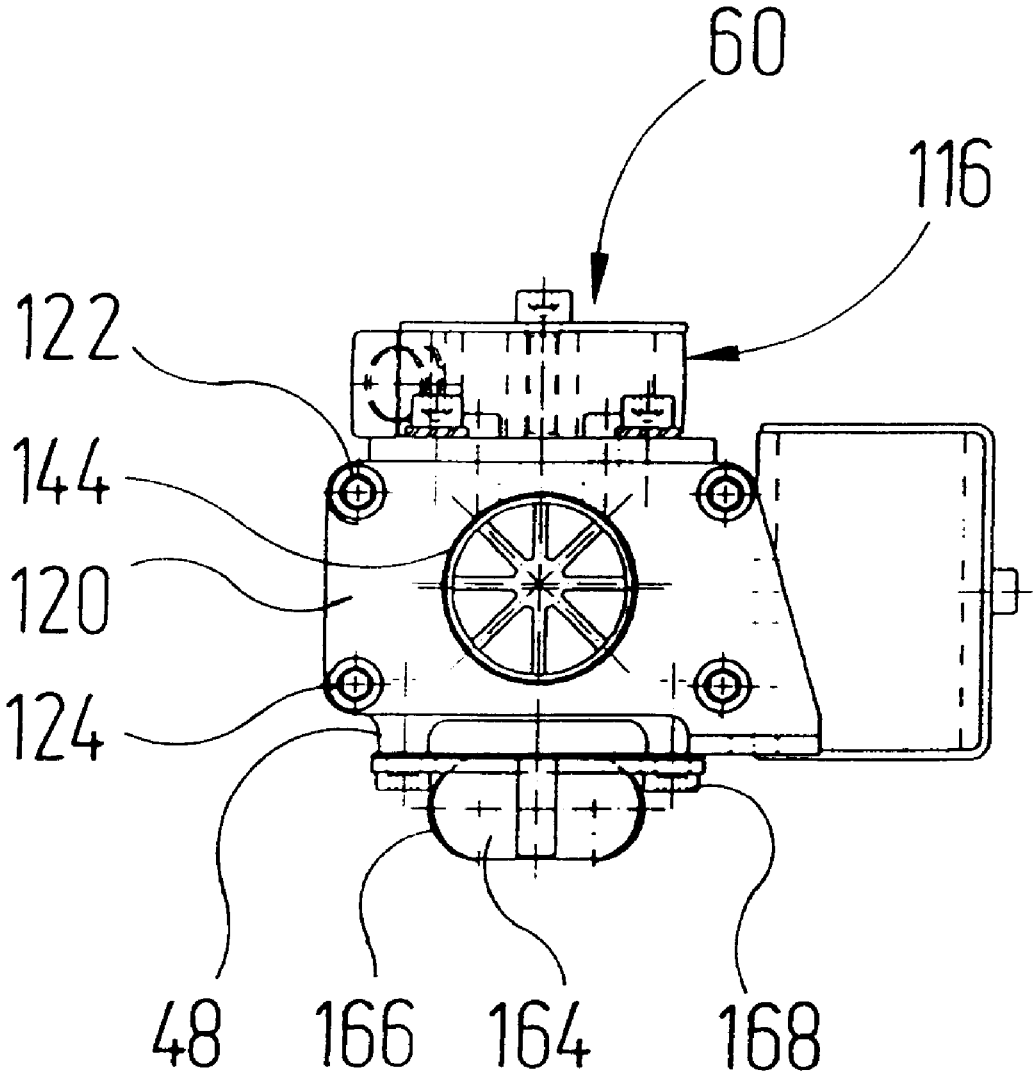

FIG. 10: an end view of the drier rail shown in FIGS. 8 and 9 viewed from the left in the drawing.

FIG. 1 shows a drier unit denoted as a whole by 10 and comprising four drier rails 12-1, 12-2, 12-3 and 12-4. Where, below, reference is made generally to the drier rails, reference is made simply to a drier rail 12.

The drier rails 12 are arranged in a grid. Situated between the drier rails 12-1 and 12-2 as well as between 12-3 and 12-4 there is in each case an empty grid, and the drier rails 12-2 and 12-3 are immediately adjacent in a flush manner.

The drier rails 12 each comprise a supporting body 14, which was obtained by cutting to length a suitable piece of a continuously extruded hollow section 16 (FIG. 4).

The hollow section 16 has an outer surface denoted as a whole by 18, the clear contour of which corresponds to a rectangle with rounded corners.

Provided near the rounded corners are longitudinal bores 20. The latter are situated near the top ends of side walls 22, 24 of the section. A top wall 26 and a bottom wall 28 together with the side walls 22, 24 form a continuous rectangle.

The side walls 22, 24 and the walls 26, 28 altogether define an inner surface 30 of the hollow section 16. From the underside 32 of the top wall 26, in the vicinity of the side ends of said wall, two reinforcing ribs 34 project in a downward direction. The latter simultaneously provide more substance in the appropriate wall region so that, at windows cut into the top wall 26 there, a larger bearing surface for installed units is obtained and optionally longer fastening bores may also be provided.

In an analogous manner the top 36 of the bottom wall 28 carries at its ends two reinforcing ribs 38, which extend obliquely upwards and inwards.

The latter, together with bottom portions 40 of the inner surfaces 42 of the side walls 22, 24 which extend obliquely downwards and inwards, delimit in each case a longitudinal distribution channel 44. The distribution channel 44 in the finish-machined hollow section is flow-connected to nozzle channels 46, which are indicated by dashes in FIG. 4 and extend through the bottom wall 28 and through nozzle ribs 48, which are carried by the latter and aligned with the distribution channel 44.

The nozzle channels 46 are distributed at right angles to the drawing plane of FIG. 4 at regular intervals over the entire length of the supporting body 14, wherein the nozzle channels 46 provided in the two nozzle ribs 48 are offset by half a pitch relative to one another.

The side walls 22, 24 are constructed with undercut assembly grooves 50, which comprise an angled bottom wall 52 and the outwardly directed open end of which is delimited by longitudinal retaining flanges 54, 56. The width of the assembly grooves 50 is selected so as to leave, next to them, a cable groove 58 in which electric lines may be accommodated.

As is apparent particularly from FIGS. 5 and 6, the drier rails 12 at either end have a heating unit 60, which is inserted into the supporting body 14 through a window 62 cut out of the top wall 26 of the drier rail. As is evident particularly from FIG. 6, the heating unit has a mounting plate 64, the outside of which via a frame 66 carries a cover plate 68. For said purpose fastening screws 70, 72 are provided, which engage from below and from above into threaded bores 74 provided in the frame 66.

The mounting plate 64 via a screw 76 carries a guide ring 78, which has an inner surface 80 tapering conically to the right in FIG. 6. The guide ring 78 near its end situated on the right in FIG. 6 is provided with a counterbore 82, which receives the one end of a heating cartridge denoted as a whole by 84. The latter has a cylindrical outer wall 86 made of heat-resistant material (e.g. ceramic material) as well as partition walls 88 made of the same material, which in axial planes extend radially inwards. The latter together with the outer wall 86 form longitudinal channels 90, which are sector-shaped in cross section.

As FIG. 7 reveals, disposed in the individual longitudinal channels 90, which are sector-shaped in cross section and delimited by the outer wall 86 and the partition walls 88, there are in each case portions 92 of a spiralled resistance wire 94. The spiral axis of each of said resistance wire portions 92 extends parallel to the longitudinal axis of the heating cartridge 84, and the various elongate resistance wire portions 92 are connected by short wire jumpers 96 which extend through recesses 98 in the end faces of the partition walls 88, thereby leaving every second one of said recesses free in each end face.

Provided in the outer surface of the outer wall 86 are axially extending grooves 100, in which non-spiralled end portions of the resistance wire 94 are led to a terminal block 102, which is mounted onto the outer surface of the outer wall 86 and carries tab connectors 104. The latter are connected to the power supply by non-illustrated connecting cables, which carry suitable connectors.

The right end of the heating cartridge 84 is held by a retaining part 106, which comprises a transverse main wall, in which an opening 108 is provided (FIG. 5), the cross section of which corresponds to the cross section of the heating cartridge 84. Three retaining fingers 110, which are offset by 900 relative to one another, spring back axially from the main wall 106.

The retaining part 106 has an angled retaining portion 112, which is connected by means of a screw 114 to the mounting plate 64.

The housing 116 formed by the parts 66 to 70 carries e.g. injection-moulded tab connectors 118, which are connected by non-illustrated cables to the tab connectors 104 and via which the power supply for the heating cartridge 84 is connected.

The ends of the supporting bodies 14 are braced with end plates 120. For said purpose use is made of long bolts 122, which are passed through the bores 20 and at the other end carry nuts 124, which cooperate with the other of the end plates 120.

The end plates 120 are provided with a regular pattern of holes, through which the bolts 122 extend. The holes of the end plates 120 which are not required for a considered embodiment of the drier unit are closed by dummy screws 126 and associated nuts 128.

In said manner the end plates 120 may form a boundary wall for an air distribution chamber 130, which is additionally delimited by a face plate 132 as well as side plates 134, 136. The connection of the end plates 120 to the face plates 132 is effected by means of bolts 138, distance sleeves 140 which surround the latter, and nuts 142.

The end plates 120 each carry a connection piece 144 and 146, which are connected to a fan 148.

The face plate 132 situated on the right in FIG. 1 moreover carries two connector parts 150, 152, which are connectable to further connector parts 154, 156 carried by electric feeder cables 158, 160 for the heating units 60.

The face plate 132 situated on the right moreover carries a pressure-operated switch 162, which is in communication with the interior of the distribution chamber 130.

As may be seen from FIG. 2, the undersides of the supporting bodies 14 carry elongate infrared radiators 164. The latter are fitted to the underside of the supporting bodies 14 by means of clips 166, which in turn are fastened to the supporting body 14 by self-tapping screws 168 screwed into one of the nozzle channels 46.

The width of the infrared radiators and the spacing of the nozzle ribs 48 is so selected that the air jets emerging from the nozzle channels 46 just get past the outside of the infrared radiators 164. Thus, said air jets are not throttled but carry heat away from the infrared radiators 164.

Electric power is supplied to the infrared radiators 164 likewise via the connector parts 150, 152.

The drier unit described above operates as follows:

Air under pressure above atmospheric is fed through the connection pieces 144, 146 to the distribution chambers 130. Said air traverses the heating units 60 and in the process is heated up to a temperature of around 120°. The heated air passes via the distribution channels 44 into the nozzle channels 46 and is discharged from there in the direction of the conveying plane of the printed products which have been imprinted.

The infrared radiators 164 are simultaneously supplied with power and emit infrared rays likewise in the direction of the printed products. In so doing, they themselves also become very hot. The hot air, which flows out through the nozzle channels 46 and has a low temperature compared to the surface temperature of the infrared radiators 164, cools the infrared radiators while, at the same time, re-heating of the hot air is effected.

In a modification of the embodiment described above, for drier units where a higher drying capacity is required, the gaps left between the drier rails 12-1 and 12-2 as well as between the drier rails 12-3 and 12-4 may additionally be filled by further identically designed drier rails. When, on the other hand, only a lower drying capacity is required, one or both of the drier rails 12-2 and 12-3 may be omitted.

In a modification of the embodiment described above, drier rails may also be used individually in the manner shown in FIGS. 8 and 9. Sub-units of the drier rail, which have already been described above with reference to FIGS. 1 to 7, are provided once more with the same reference characters and. are not described in detail again.

In the drier rail 12 according to FIGS. 8 and 9, the connection pieces 144 and 146 are mounted directly onto the end plates 120, and the end plates 120 comprise bottom retaining portions 170, which are folded back and each have an opening 172 for receiving a fastening screw, by means of which the drier rail is fitted to frame parts of the printing machine.

An electrical terminal box 174 is mounted onto the side of the supporting body 14.

As may be seen from FIG. 3, a section 176 having a reverse P-shaped cross section is screwed onto the outer assembly groove 50 and in its top portion defines a channel extending in longitudinal direction of the drier rail. Screw-connected to the section 176 is a further section 178, which has the shape of a downwardly open U-shaped channel. Three castors 180, which project down beyond the section 178, are successively supported against the section 178 in a direction at right angles to the drawing plane of FIG. 3.

What is claimed is:

1. A drier unit for drying printed products, having at least one elongate supporting body (14) and a heat source (60; 164) disposed on the latter, wherein the supporting body (14) comprises a hollow section, the outer contour of which is substantially rectangular and which has a wall (22, 24, 26, 28) and a lumen defined by the latter, and wherein an outer surface of the hollow section (16) carries two spaced-apart, outwardly projecting nozzle ribs (48).

2. A drier unit as claimed in claim 1, wherein the outer surface of the hollow section (16) carries two spaced-apart, outwardly projecting nozzle ribs (48).

3. A drier unit as claimed in claim 1, wherein provided in the nozzle ribs (48) are two sets of nozzle channels (46), which are arranged successively at regular intervals.

4. A drier unit as claimed in claim 2, wherein projecting inwards from the inner surface (30) of the hollow sections (16) are longitudinal reinforcing ribs (38) which, together with adjacent inner surfaces (42) of the hollow section (16), delimit in each case a distribution channel (44).

5. A drier unit as claimed in claim 4, wherein the distribution channel (44) tapers in the direction of nozzle channels (46).

6. A drier unit as claimed in claim 5, wherein an inner surface of the hollow section (16) lying opposite the wall (28) of the hollow section (16) provided with the reinforcing ribs (38) is provided with further longitudinal reinforcing ribs (34).

7. A drier device as claimed in claim 1 wherein longitudinal cylindrical receivers (20) are formed close to the corners of the outer surface (18) of the hollow section (16).

8. A drier device as claimed in claim 2 wherein the outer surfaces of the hollow section (16), which are perpendicular to the outer surface carrying the nozzle ribs (48), comprise in each case at least one longitudinal assembly groove (50) and/or one longitudinal cable groove (58).

9. A drier unit as claimed in claim 1, wherein the outer surfaces of the hollow sections (16) carrying nozzle ribs (48) carry in each case an elongate infrared radiator (164).

10. A drier unit as claimed in one of claims 1 to 9, wherein the supporting body (14) near at least one end comprises windows (62), into which a resistance heating unit (60) is inserted.

11. A drier unit as claimed in claim 10, wherein the resistance heating unit (60) comprises two axially spaced-apart retaining parts, of which at least one is releasably connected to a mounting plate (64) and which lap over the ends of a heating cartridge.

12. A drier unit as claimed in claim 11, wherein at least an upstream retaining part (78) comprises a guide surface (80).

13. A drier unit as claimed in claim 11, wherein the downstream retaining part is a bent sheet-metal component, which comprises a retaining wall, which holds the adjacent end of the heating cartridge (84) and extends in peripheral direction, or a plurality of retaining fingers (110) distributed in peripheral direction.

14. A drier unit as claimed in one of claim 11, wherein there is a contact carrier (102) connected to the heating cartridge (84).

15. A drier unit as claimed in claim 11, wherein the heating cartridge (84) comprises a cylindrical outer wall (86) and partition walls (88) extending from the latter radially towards the axis of the outer wall (86), wherein said walls are made of an electrically insulating, heat-resistant material, and wherein in the sector-shaped longitudinal channels (90) delimited by said walls spiralled portions (92) of a resistance wire (94) are situated in such a way that the spiral axis extends parallel to the axis of the outer wall (86).

16. A drier unit as claimed in claim 15, wherein the partition walls (88) have recesses (98) in their end faces.

17. A drier unit as claimed in claim 15, wherein the outer wall (86) comprises surface grooves (100), which extend in axial direction and lead to a terminal block (102) mounted onto the outer wall (86).

18. A drier unit as claimed in one of claim 1 to 17, wherein ends of the supporting body (14) are fastened to end plates (120).

19. A drier unit as claimed in claim 18, wherein the end plates (120), together with face plates (132) parallel thereto, as well as wall parts (134, 136) connecting said two plates delimit distribution channels (130).

20. A drier unit as claimed in claim 19, wherein the distribution channels (130) situated at both ends of the drier rails (12) communicate in each case with a connection piece (144, 146), which is in turn connectable to a fan (148).

21. A drier unit as claimed in claim 1, wherein provided in the nozzle ribs (48) are two sets of nozzle channels (46), which are arranged at regular intervals, wherein the nozzle channels (46) of the two sets are preferably offset by half a pitch relative to one another.

22. A drier unit for drying printed products, having at least one elongate supporting body (14) and a heat source (60; 164) disposed on the latter, wherein the supporting body (14) comprises a hollow section, the outer contour of which is substantially rectangular; and windows (62) near at least one end thereof, into which a resistance heating unit (60) is inserted, the resistance heating unit (60) comprises two axially spaced-apart retaining parts, of which at least one is releasably connected to a mounting plate (64) and which lap over the ends of a heating cartridge (84).

* * * * *